US006238773B1

(12) United States Patent
Schlüter

(10) Patent No.: US 6,238,773 B1
(45) Date of Patent: May 29, 2001

(54) PROFILED SHAPE TO BE GLUED TO A SURFACE FOR FINISHING THE EDGES OF SET CERAMIC TILES OR SIMILAR ITEMS

(75) Inventor: Werner Schlüter, Iserlohn (DE)

(73) Assignee: Schlüter-Systems KG, Iserlohn (DE)

( * ) Notice: Subject to any disclaimer, the term of this patent is extended or adjusted under 35 U.S.C. 154(b) by 0 days.

(21) Appl. No.: 09/284,546

(22) PCT Filed: May 15, 1998

(86) PCT No.: PCT/EP98/02885

§ 371 Date: Apr. 15, 1999

§ 102(e) Date: Apr. 15, 1999

(87) PCT Pub. No.: WO98/54423

PCT Pub. Date: Dec. 3, 1998

(30) Foreign Application Priority Data

May 28, 1997 (DE) ..... 197 22 349

(51) Int. Cl.[7] ..... B32B 23/02

(52) U.S. Cl. ..... 428/192; 52/287.1; 52/717.05; 52/717.06

(58) Field of Search ..... 428/131, 192, 428/119; 52/287.1, 288.1, 731.7, 730.6, 717.5, 717.6

(56) References Cited

FOREIGN PATENT DOCUMENTS

| | | |
|---|---|---|
| 31 21 823 | 11/1988 | (DE) . |
| 296 19 170 | 4/1997 | (DE) . |
| 2306980 | 5/1997 | (GB) . |

*Primary Examiner*—William Krynski
*Assistant Examiner*—B. Shewareged
(74) *Attorney, Agent, or Firm*—Collard & Roe, PC

(57) ABSTRACT

The invention relates to an angular profiled shape (3) designed to be glued to a surface for finishing the edges of set ceramic tiles (5,6) or similar items. Said profiled shape comprises a first perforated leg (31) and a second leg (33) joined to the first leg at an angle. On said second leg distancing means are embodied pointing in the direction of the adjoining ceramic tile (5,6) which determine the visible joint width (B) between the outer leg (35) and said adjoining ceramic tile (5,6). To this end, a chamber open only to one side is embodied, together with the thickened area (34) forming the distancing means (36), at the free end of the leg (35) in the direction of the side of the ceramic tile whose edge is to be finished.

4 Claims, 2 Drawing Sheets

PROFILED SHAPE TO BE GLUED TO A SURFACE FOR FINISHING THE EDGES OF SET CERAMIC TILES OR SIMILAR ITEMS

BACKGROUND OF THE INVENTION

1. Field of the Invention

The invention relates to an angle section for terminating laid ceramic tiles.

2. The Prior Art

It is known to protect ceramic tiles installed on the floor or on the wall on their exposed outer edges by terminating sections as disclosed in DE-PS 31 21 823. Such sections have substantially an L-shaped cross section. The longer leg is in this connection provided with breakthroughs and, when installed by the so-called thin-bed method in an adhesive, is accommodated between the substrate, which may be either a floor or a wall, and the ceramic tiles laid on the latter. The second leg, which is disposed vertically relative to the first leg, which is the fastening leg, is a terminating leg. At its free end of the latter, provision is made for a widening, which is directed inwardly toward the side of the tile, with a chamber being formed under said widening. When such sections are installed under the adjacent ceramic tiles to be protected, it is found that it is difficult to maintain a desired and constant joint between the widening of the terminating section and the edge of the ceramic tiles to be protected. Furthermore, it is difficult to fill the resulting space of the joint with joint mortar especially when the joint has a relatively narrow visible width, while the space of the joint, however, has a relatively large depth corresponding with the total thickness of a ceramic tile. As a rule, such a protective section is first placed on the substrate, secured with adhesive mortar, and the ceramic tile is subsequently placed on top. In this process, the lower region of the joint or chamber so formed is already filled with the adhesive. The outwardly visible joint, however, is completely filled with a joint mortar, which has a consistency different from the one of the adhesive mortar. In any case, the adhesive mortar has to be prevented from completely filling the space of the joint, in which case it would be visible from the top. In this case, the desired joint mortar no longer can be admitted in an adequate amount.

A terminating section for shaping the corner of a wall segment, where ceramic tiles have to be installed vertically relative to one another, has been proposed in GB 2 203 996 A1. Said section has two mounting legs disposed vertically relative to one another. Said fastening legs each have to be accommodated on both walls under the respective outer ceramic tiles. The connection forms an approximately quarter-cylindrical segment consisting of two terminating legs disposed vertically relative to each other, and a curved bridge connecting said legs on their outer ends. In order to obtain a constant joint spacing between the terminating legs and the edges of the ceramic tiles to be protected, bridge strips projecting in about their centers are shaped by molding on the terminating legs, said bridge strips being directed in about the center toward the edges of the tiles. The thickness of said bridge strips determines the joint spacing between the terminating leg and the adjacent edge of the tile. It was found in practical application that it is extremely difficult to install such a section with two mounting legs. Its installation seems only possible if the surfaces of the substrate in the corner region are exactly set at a right angle relative to one another. Compensating a tolerance of the angle seems not to be possible because when one mounting leg has been secured, the other mounting leg can be retained on its substrate only under pressure. Resilience of the section, however, would lift off the tiles that are to be installed in said region on top of the mounting leg. Furthermore, the widening on the end of the terminating legs, which leads to the formation of a chamber and which highly promotes bracing of the joint mortar and the protection of the adjacent edges of the tiles, is missing on such sections.

SUMMARY OF THE INVENTION

The object of the invention is to provide an angle section of the type specified above which can be installed under ceramic tiles free of stress, and which satisfies the function of securing the filling of the joints and thus of protecting and supporting the edges of the tiles.

The object of the invention is achieved with an angle section of the invention. The invention proposes sections which need to be secured under ceramic tiles to be protected with only one fastening leg. A widening provided on the end of the second leg of said section, jointly with the spacer means for forming the joints, forms chambers which separate the joint mortar from the adhesive mortar. Said chambers, in a manner known per se, satisfy the requirements with respect to the clamping possibility for the joint mortar, whereby the protection of the adjacent tile edges remains secured by the widening. Simple maintenance of the spacing for the visible joint to be formed is accomplished and no adhesive mortar can penetrate the joint mortar.

Angle sections are provided for forming corners in wall regions. Such sections are secured only on one side of the wall area formed and to be covered with ceramic tiles. The tile covering disposed vertically relative to such sections can be moved against the correspondingly shaped section in the way of a gauge. The width of the joint is determined on both sides of the section. Undercut chambers formed between the widening and the spacer means receive the joint mortar, which again remains separated from the adhesive mortar of the substrate.

BRIEF DESCRIPTION OF THE DRAWINGS

The invention is explained in greater detail in the following with the help of exemplified embodiments representing basic designs. In the drawing.

DETAILED DESCRIPTION OF THE EMBODIMENTS

Figure 1:
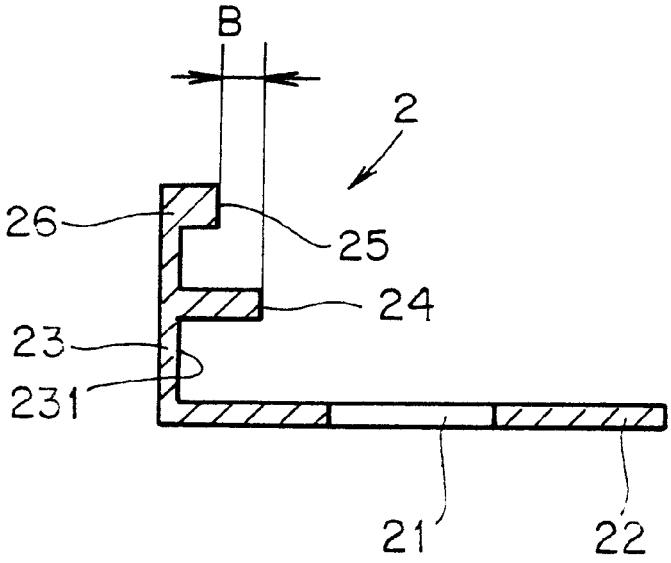
FIG. 1 shows an enlarged cross section through an approximately L-shaped section.

The section 2 in FIG. 1 is preferably employed in the floor region, for example for limiting a covering of ceramic tiles or for limiting fields of tiles. Such a section with an approximately L-shaped cross section is accommodated with its first broken-through fastening leg 21, on which provision is made for the break-throughs 22, between the ceramic tile and the substrate, glued into a suitable adhesive mortar preferably by the thin-bed method. The corresponding outer edge of the ceramic tile not shown abuts in this connection the spacer bridge 24, which is shaped by molding on the inner side 231 of second terminating leg 23. At the upper end of terminating leg 23, such sections have an inwardly directed widening or a widening bridge 26, the top side of which is preferably rising. The length of widening bridge 24 is by one joint width "B" larger than the upper visible width of the outer side of the section. The face edge of said outer side is denoted by reference numeral 25.

Figure 2:
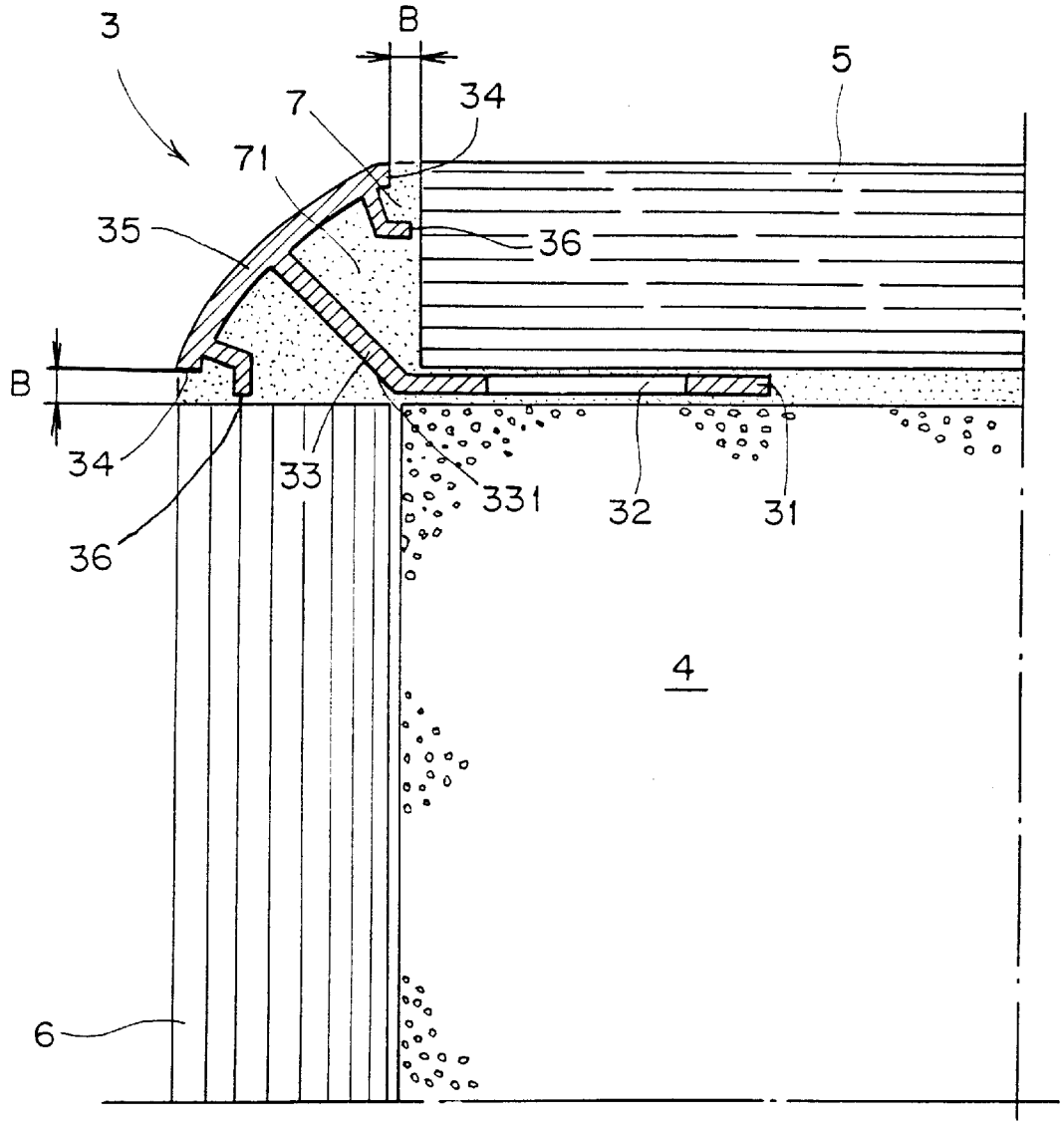
FIG. 2 shows a cross section through a section for forming a corner, in its installed condition.

The section 3 shown in FIG. 2 serves for forming a corner preferably in the region of two walls covered with ceramic tiles. The wall substrate is denoted by reference numeral 4. The ceramic tiles each are denoted by reference numeral 5. Section 3 is accommodated under one of said ceramic tiles 5 with its first broken-through mounting leg 31, which again is provided with break-throughs 32. A connecting second leg 33 is shaped by molding on mounting leg 31 at an obtuse angle and an outer leg 35 forming about a T-shape together with connecting leg 33 is tied again to said connecting leg 33 on the outside. Spacer bridges 36 having a selected length and a matching shape are shaped by molding on the underside of said outer leg 35, said spacer bridges determining the spacing of the outer edges of ceramic tiles 5 from the end segments 34 of the curved outer legs 35 and thus joint width "B". Such spacer bridges may be shaped also on connecting leg 33 in basically the same way. Numeral 7 denotes the joint space filled with joint mortar, the latter having been admitted into said space.

Space 71 can be filled with adhesive mortar before the tiles are laid. Spacer bridges 36 serve in this connection also as a separation between the adhesive mortar and the joint mortar.

List of Reference Numerals and Letters

1 Section
11 Underside
12 Groove
13 Longitudinal side
14 Spacer bridge
15 Outer side of section
2 Section
21 Mounting leg
22 Breakthrough
23 Terminating leg
231 Inner side
24 Spacer bridge
25 Outer side of section
26 Widening bridge
3 Section
31 Mounting leg
32 Breakthrough
33 Connecting leg
331 Longitudinal side
34 End segment
35 Outer leg
36 Spacer bridge
4 Substrate
5 Ceramic tile
6 Ceramic plate
7 Joint space
71 Space
B Width of joint

What is claimed is:

1. An angle section to be glued to the side of a substrate for terminating installed ceramic tiles comprising:

a first broken-through leg (21) for fastening the angle section;

a second leg (23) attached to said first leg (21) at an angle;

a spacing element (24) molded to said second leg (23) extending towards adjacent ceramic tiles for determining a visible joint width between said second leg and the adjacent ceramic tiles; and a widening element (26) molded to a free end of said second leg (23) and forming a chamber with said spacing element, said chamber having an opening facing the ceramic tile to be terminated, wherein said widening element is shorter than said spacing element forming a joint width B; and said chamber is for receiving a joint mortar and said chamber is separated from an area underneath for receiving an adhesive mortar.

2. The angle section according to claim 1, wherein said spacing element (24) comprises a spacing bridge.

3. An angle section to be glued to the side of a substrate for terminating installed ceramic tiles comprising:

a first broken-through leg (31) for fastening;

a second leg (33) attached to said first leg (31) at an obtuse angle;

an outer leg (35) attached to said second leg (33) extending transversely therefrom and having end sections (34) forming a visible joint in relation to adjacent ceramic tiles (5, 6);

a spacing bridge (36) molded to said outer leg extending towards the adjacent tiles, wherein said spacing bridge (36) forms a chamber between said end sections (34), said chamber having an opening towards the ceramic tile to be terminated to determine a visible joint width B; and said chamber is for receiving a joint mortar and said chamber is separated from an area underneath for receiving an adhesive mortar.

4. The angle section according to claim 3, wherein said outer leg (35) is molded onto said second leg (33) forming a "T" shape.

* * * * *